US009051097B1

(12) United States Patent
Michiel

(10) Patent No.: US 9,051,097 B1
(45) Date of Patent: Jun. 9, 2015

(54) APPARATUS FOR DETERRING AND DETECTING TAMPERING WITH A BOTTLENECK CAP OF A BOTTLE AND METHOD FOR THE SAME

(71) Applicant: Richard J. Michiel, Nesconset, NY (US)

(72) Inventor: Richard J. Michiel, Nesconset, NY (US)

( * ) Notice: Subject to any disclaimer, the term of this patent is extended or adjusted under 35 U.S.C. 154(b) by 170 days.

(21) Appl. No.: 13/694,079

(22) Filed: Oct. 26, 2012

(51) Int. Cl.
*B65D 55/08* (2006.01)
*B65B 7/28* (2006.01)
*B65D 77/00* (2006.01)

(52) U.S. Cl.
CPC ..... *B65D 55/08* (2013.01); *B65B 7/2842* (2013.01); *B65D 77/00* (2013.01)

(58) Field of Classification Search
CPC ..... B65D 85/00; B65D 50/00; B65D 50/02; B65D 55/08; B65D 55/089; B65D 55/0818
USPC ..... 215/201, 207, 215, 216; 70/164, 158, 70/163, 167, 166; 206/223, 577; 53/416
See application file for complete search history.

(56) References Cited

U.S. PATENT DOCUMENTS

| | | | | |
|---|---|---|---|---|
| 2,634,013 | A * | 4/1953 | Atwood | 215/327 |
| 3,191,765 | A * | 6/1965 | Dozier | 206/207 |
| 4,079,485 | A * | 3/1978 | Collier et al. | 24/16 PB |
| 4,767,016 | A | 8/1988 | Cook, Jr. et al. | |
| 4,971,374 | A * | 11/1990 | Lovell et al. | 292/339 |
| 5,121,845 | A | 6/1992 | Blanchard | |
| 5,123,686 | A * | 6/1992 | Wenk | 292/321 |
| 5,602,530 | A * | 2/1997 | Holmgren | 340/572.1 |
| 6,326,890 | B1 * | 12/2001 | Costa | 340/572.9 |
| 6,592,034 | B1 | 7/2003 | Millard et al. | |
| 6,793,081 | B1 | 9/2004 | Derman | |
| D515,416 | S * | 2/2006 | Haggard et al. | D9/434 |
| 7,878,033 | B2 * | 2/2011 | Fawcett et al. | 70/58 |
| 8,294,583 | B2 * | 10/2012 | Sayegh et al. | 340/572.9 |
| 2004/0206719 | A1 | 10/2004 | Hazggard et al. | |
| 2005/0211658 | A1 * | 9/2005 | Bagration De Ulloa | 215/275 |
| 2008/0030334 | A1 * | 2/2008 | Marsilio et al. | 340/572.1 |
| 2008/0093255 | A1 * | 4/2008 | Greaves et al. | 206/579 |
| 2008/0289372 | A1 * | 11/2008 | Rendon et al. | 70/57.1 |
| 2010/0005840 | A1 * | 1/2010 | Hogan et al. | 70/63 |
| 2010/0071169 | A1 * | 3/2010 | Williams et al. | 24/16 PB |
| 2010/0084364 | A1 * | 4/2010 | Martin | 215/201 |
| 2010/0288720 | A1 * | 11/2010 | Jones | 215/201 |
| 2012/0024962 | A1 * | 2/2012 | Kolton et al. | 235/492 |
| 2012/0222980 | A1 * | 9/2012 | Lambalot et al. | 206/438 |

* cited by examiner

*Primary Examiner* — Steven A. Reynolds
(74) *Attorney, Agent, or Firm* — Richard B. Klar; Law Office Richard B Klar

(57) ABSTRACT

A method, an apparatus and a kit that provides for deterring and for deterring and detecting the tampering of a bottle. A latex covering is placed over a bottleneck of a bottle and a zip tie is then wrapped around the circumference of the bottleneck. The zip tie preferably has a custom name and serial number thereon.

8 Claims, 4 Drawing Sheets

APPARATUS FOR DETERRING AND DETECTING TAMPERING WITH A BOTTLENECK CAP OF A BOTTLE AND METHOD FOR THE SAME

RELATED APPLICATIONS

This is a non provisional application of provisional application Ser. No. 61/629,037 by Richard J. Michiel filed Nov. 10, 2011.

BACKGROUND

1. Field

The present invention relates to a method and an apparatus for deterring and for detecting tampering of bottles. In particular, the present invention relates to providing a covering that would have to be impaired and removed for an unauthorized user to obtain access to the contents inside of a bottle.

2. The Related Prior Art

One major problem with certain bottles such as liquor and medicine bottles is that children and in particular adolescents can drink or otherwise consume the contents in these bottles and get sick as a result. If they drink or consume the pills and get behind the wheel of a car, they can injure themselves or others. The best way to safe guard this is to provide a tamper proof seal on the bottle. A number of prior art proposals have endeavored to provide solutions to safeguard bottles.

U.S. Pat. No. 4,767,016 to Cook et al. discloses a replacement cap for a liquor bottle. This mechanism is expensive to make and must be implemented by the manufacturer.

U.S. Pat. No. 6,592,034 to Millard et al. discloses a tamper proof closure for a bottle requiring magnetic strips. This again is an expensive solution requiring a closure mechanism implemented at the manufacturers' end rather than one that an individual can place on any bottle at home.

U.S. Pat. No. 6,793,081 to Derman et al. relates to a locking neck ring device in which a ring has a protrusion gripping the bottle neck ring. This again is expensive.

US Patent Publication No. 2004/0206719 to Haggard et al. relates to another locking mechanism that is complex and expensive to manufacture.

Thus the prior art proposals require cumbersome, complex and expensive closure mechanisms that might not be suitable for all bottle necks of bottles.

It therefore would be desirable to find an inexpensive closure mechanism which can be replaced on any bottle and removed when desired and which when removed by an unauthorized user can be detected to ensure that the owner of the bottle is aware of any tampering with the mechanism and possible use of the bottle by others such as adolescents and young children in the household.

SUMMARY

The present invention provides a method and an apparatus for preventing undetected tampering with a bottleneck of a bottle. The present invention accomplishes this by providing a covering preferably of a latex material over a bottleneck of a bottle and securely fastening the base of the latex with a zip tie band. The present invention would provide for tamper resistant security to bottles such as medicine and liquor bottles from unauthorized users such as minors. The present invention could also be used as a child safety device to protect small children from opening detergent bottles or bottles containing poison that may be stored in accessible locations such as under the sink.

The latex covering and/or the zip ties can be coded by color and/or name impressed to ensure the same latex covering and/or zip tie is in place when the authorized user inspects the bottleneck for tampering.

The present invention can be offered in a kit with a number of latex coverings and zip ties in the kit. The kit would also include a box with a lock to contain the latex coverings and zip ties, so that an unauthorized user cannot have access to them.

BRIEF DESCRIPTION OF THE PREFERRED EMBODIMENTS

DETAILED DESCRIPTION OF THE PREFERRED EMBODIMENTS

Figure 1:
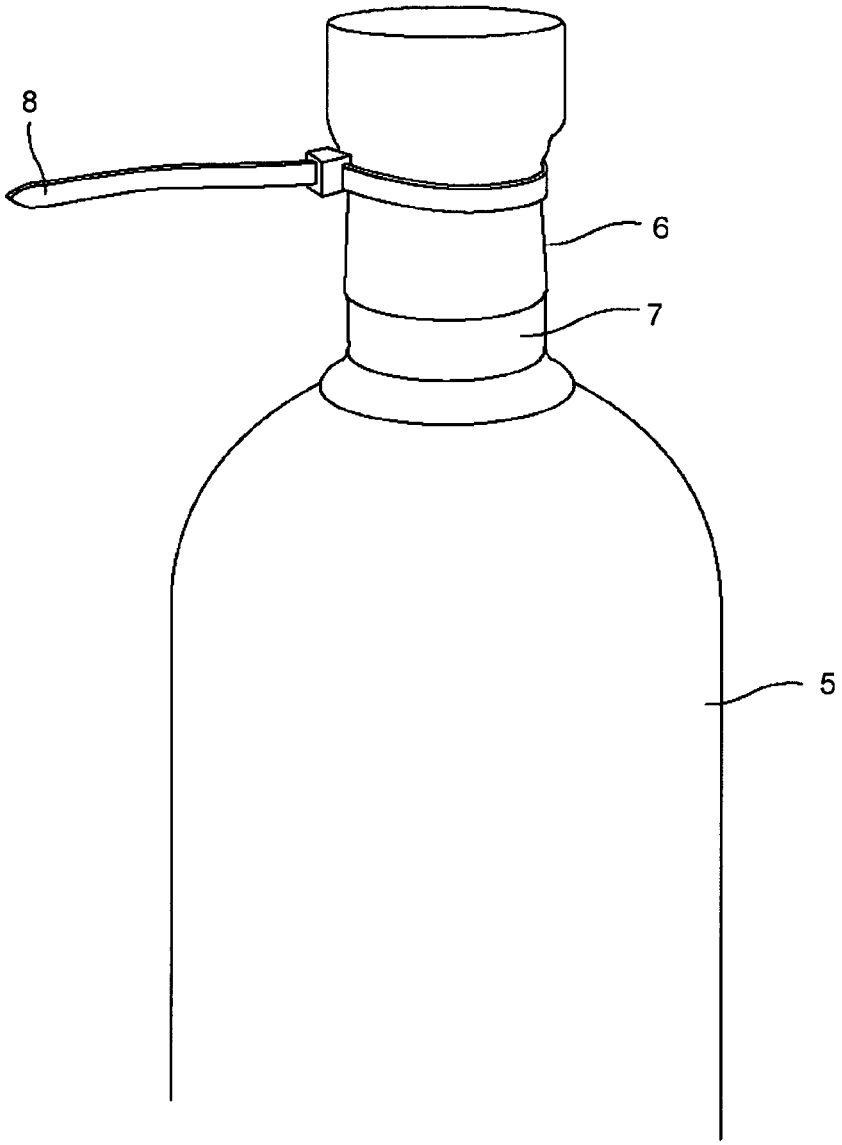
FIG. 1 is an illustration of the present invention.
Figure 2:
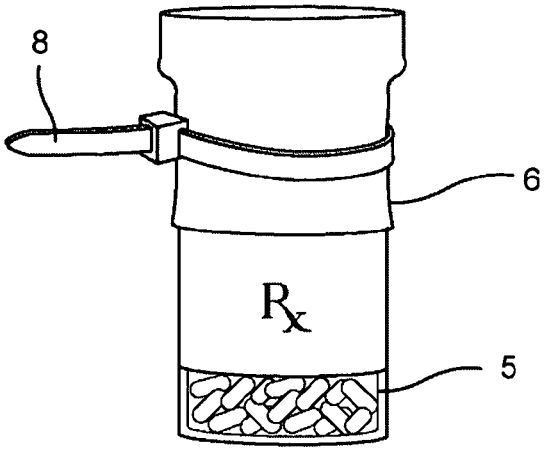
FIG. 2 is another embodiment of the present invention.
Figure 3A:
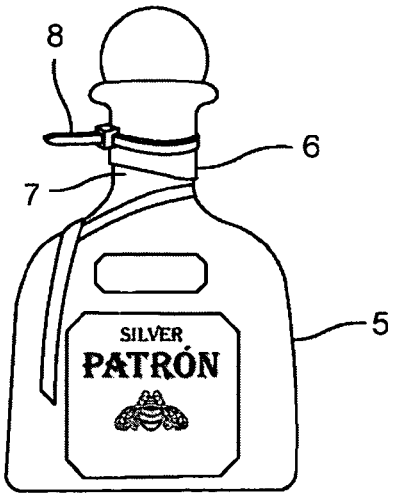
FIG. 3A shows the present invention utilized on one type of bottle.
Figure 3B:
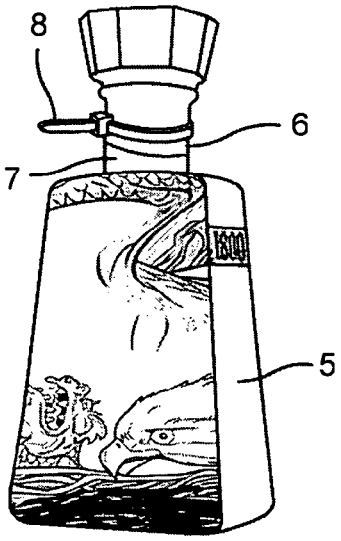
FIG. 3B shows the present invention utilized on another type of bottle.
Figure 6:
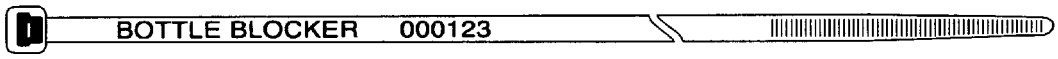
FIG. 6 is an embodiment of the present invention in which the zip tie has a custom name and serial number thereon.

Referring to the drawings of FIGS. 1 through 4, a bottle 5 is shown. The bottles may be a liquor bottle or a medicine bottle or any other kind of bottle that needs to be kept out of the hands of children. A cap covering for the bottleneck 7 of the bottle 5 the cap covering 6 is preferably made of latex material but it is understood that the present invention is not intended for use by one elastic type of material. The cap snugly fits over the bottleneck 7 of the bottle 5. A zip tie 8 custom designed can secure the circumference of the bottleneck 7 once the latex cap covering 6 is placed therein as shown in FIG. 1. Again, it is understood that the present invention is not limited to any one type of elastic material or covering such as latex material and that any type of elastic material can be used as is known in the art for the present invention. It is further understood that the present invention is not limited to a zip tie 8 and any other known substitute can be used in place therefor. The zip tie 8 is preferably customized to have a custom name and serial number thereon (see FIG. 6). By placing the name and number on the zip tie 8 this permits the authorized user to know if the zip tie has been replaced with another zip tie after the original zip tie has been removed by an unauthorized user. The present invention could also be used as a child safety device to protect small children from opening detergent bottles or bottles containing poison that may be stored in accessible locations such as under the sink.

Figure 4:
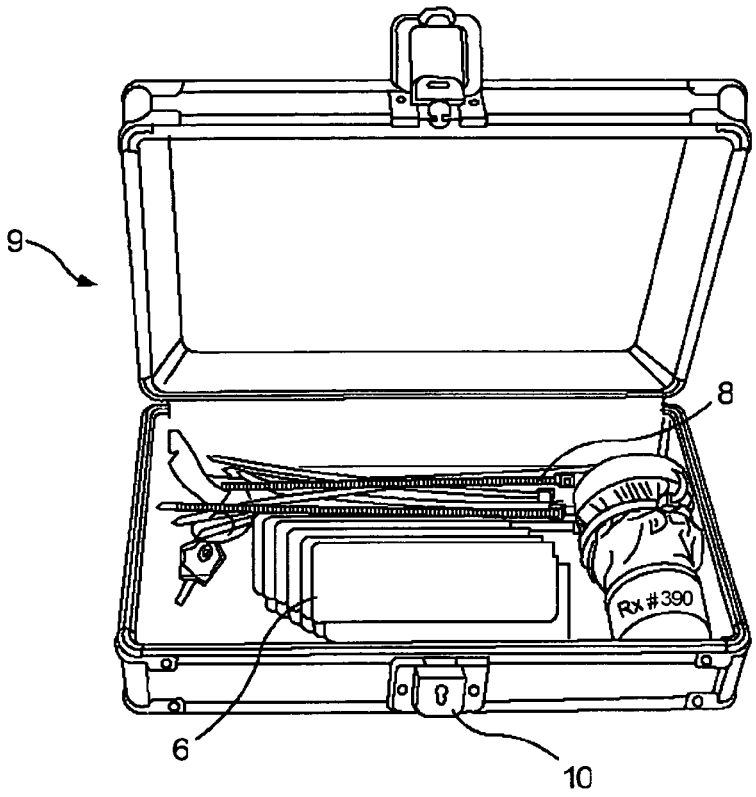
FIG. 4 is another embodiment of the present invention as a kit with a locking box, with the box in an open and unlocked position.
Figure 5:
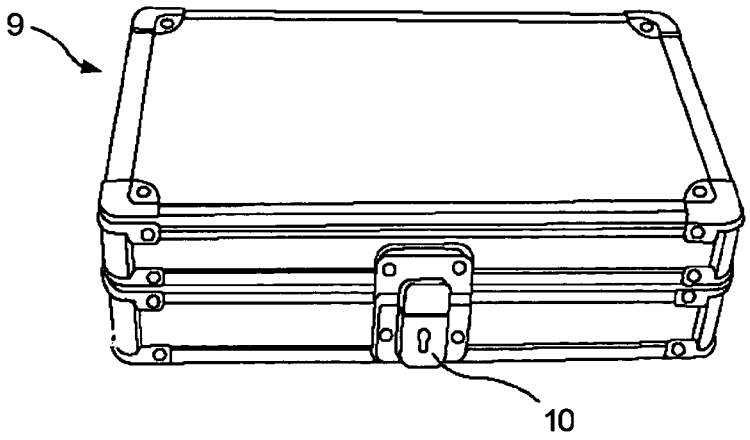
FIG. 5 is the embodiment of FIG. 4 with the box in a closed and locked position.

The present invention can also be sold as a kit (FIG. 4) with latex covering caps and zip ties with replacement pieces so that after the bottle is used by the authorized user, the used cap and tie can be replaced with a new zip tie 8 and possibly a new latex covering. The replacement zip ties and replacement covers are stored in a supplied box with a lock 10 to prevent access by unauthorized users. FIG. 4 shows the present invention as a kit, with additional cap coverings 6, and additional custom zip ties 8, stored in a box 9 (see FIG. 5) that can be locked to prevent unauthorized access. The box 9 is shown in open and closed positions in FIGS. 4 and 5, respecti vely.

The invention claimed is:

1. A method for determining and detecting tampering activity of a bottleneck of a bottle, the steps comprising:

placing a latex covering over a bottleneck of a bottle, said latex having an interior surface free of adhesive material that makes contact with said bottleneck of said bottle; and securing said latex covering of said bottleneck of said bottle with a zip tie by wrapping and tying said zip tie around a circumference of said bottleneck so as to prevent opening of said bottleneck by requiring an authorized user to remove said latex covering and said zip tie, said zip tie having a custom name and a serial number placed on a surface area of said zip tie so that an authorized user knows if said zip tie has been replaced with another zip tie after said zip tie has been removed by an unauthorized user.

2. The method according to claim 1 wherein said secured latex covering said bottleneck of said bottle provides for a child safety device to protect small children from opening detergent bottles or bottles containing poison that may be stored in accessible locations such as under the sink.

3. An apparatus for deterring and detecting tampering of a bottleneck of a bottle by an unauthorized user, comprising:

a latex covering for firmly covering a bottleneck of a bottle, said latex having an interior surface that is adhesive free and makes contact with said bottleneck; and a zip tie for securing said latex covering to said bottleneck by wrapping said zip tie around a circumference of said bottleneck so that when said bottleneck is covered by said latex covering and said zip tie is undetected opening of said bottleneck is prevented by other than an authorized user, said zip tie having a custom name and a serial number placed on a surface area of said zip tie so that an authorized user knows if said zip tie has been replaced with another zip tie after said zip tie has been removed by an unauthorized user.

4. The apparatus according to claim 3 wherein said apparatus is used as a child safety device so as to protect small children from opening detergent bottles or bottles containing poison that may be stored in accessible locations such as under the sink.

5. A kit for deterring and detecting tampering of a bottleneck of a bottle by an unauthorized user, comprising:

a plurality of latex coverings each for firmly covering a bottleneck of a bottle each of said latex coverings having an interior surface that is adhesive free and makes contact with said bottleneck; and a plurality of zip ties, each for securing said latex covering to said bottleneck by wrapping said zip tie around said circumference of said bottleneck, each of said zip ties each having a custom name and a unique serial number placed on a surface area of each said zip tie so that an authorized user knows if said zip tie has been replaced with another zip tie after said zip tie has been removed by an unauthorized user.

6. The kit according to claim 5 further comprises a box with a lock in which said latex coverings and said custom zip ties are stored so they are not accessible by unauthorized users.

7. The kit according to claim 5 wherein when said kit includes replacement latex coverings and zip ties when necessary for said bottleneck covered by said latex covering and said zip tie after removal of a previous latex covering and a previous zip tie.

8. The kit according to claim 5 wherein said kit provides for supplying a bottle containing detergent or poison with a child safety device to protect small children from opening said detergent bottle or said bottle containing poison that may be stored in accessible locations such as under the sink.

* * * * *